United States Patent [19]

Compton

[11] 4,111,303

[45] Sep. 5, 1978

[54] PLASTICS CONTAINERS

[75] Inventor: Peter Arnold Compton, King's Lynn, England

[73] Assignee: Mars Limited, London, England

[21] Appl. No.: 709,853

[22] Filed: Jul. 29, 1976

[30] Foreign Application Priority Data

Aug. 1, 1975 [GB] United Kingdom ..... 32345/75
Mar. 17, 1976 [GB] United Kingdom ..... 10799/76

[51] Int. Cl.[2] ..... B65D 21/02; B65D 85/72
[52] U.S. Cl. ..... 206/520; 206/217; 206/519; 229/1.5 B
[58] Field of Search ..... 206/217, 219, 515, 519, 206/520; 229/1.5 B

[56] References Cited

U.S. PATENT DOCUMENTS

| | | | |
|---|---|---|---|
| 2,345,876 | 4/1944 | Kohrtz | 206/515 |
| 2,995,269 | 8/1961 | Pease | 220/307 |
| 3,424,365 | 1/1969 | Venturi | 220/307 |
| 3,512,677 | 5/1970 | Kovac | 229/1.5 B |
| 3,934,725 | 1/1976 | Edwards | 206/519 |

FOREIGN PATENT DOCUMENTS

| | | | |
|---|---|---|---|
| 965,358 | 4/1975 | Canada | 229/1.5 B |
| 1,395,026 | 5/1975 | United Kingdom. | |
| 1,197,630 | 12/1967 | United Kingdom. | |
| 1,038,897 | 8/1966 | United Kingdom. | |
| 1,292,217 | 11/1972 | United Kingdom. | |
| 538,583 | 8/1941 | United Kingdom. | |
| 1,239,093 | 7/1971 | United Kingdom. | |
| 1,345,983 | 2/1974 | United Kingdom. | |
| 1,188,989 | 4/1970 | United Kingdom | 206/519 |

*Primary Examiner*—George E. Lowrance

[57] ABSTRACT

A nestable container of resilient plastics material comprises integral bottom and side walls, the side walls diverging generally from the bottom to the top. The container has means for holding the containers together in a stack, comprising projections which provide pairs of mutually opposed shoulders on the outside of the container and projections on the inside of the container. The space between the shoulders of each pair is slightly less than the width of each projection on the inside of the container so that when such identical containers are brought together the shoulders on one container are displaced circumferentially to allow the projections on the inside of the other container to pass between them and engage behind them holding the cups together.

27 Claims, 8 Drawing Figures

PLASTICS CONTAINERS

BACKGROUND OF THE INVENTION

The present invention relates to plastics containers, particularly containers capable of nesting one inside another to form a stack. The invention is concerned particularly but not exclusively with containers which, when nested together to form a stack, have spaces between pairs of adjacent bottom walls filled with the dry ingredients for a beverage, these spaces being sealed by abutment of parts of the walls of the respective containers. Such containers are used in automatic vending machines, the containers being separated individually from a stack and automatically filled with water when the machine is operated, and in domestic applications where the containers may be separated and filled with water by hand to make the beverage.

DESCRIPTION OF THE PRIOR ART

In known containers of this kind, the wall of the container is provided on its inside with an annular projection and on its outside with an annular groove, the groove being disposed below the projection. When the containers are fitted together in a stack, the annular projection of each container interlocks with the annular groove of the container next above it so as to secure the containers to one another. When the containers are brought together to form the stack and when they are separated, the walls of the container are deflected radially to allow the annular projection to pass over the wall of the container adjacent the groove.

The present invention is concerned with an alternative arrangement for holding the containers together in the stack.

SUMMARY OF THE INVENTION

According to the present invention there is provided a nestable container of resilient plastics material comprising bottom and side walls, the side walls diverging generally from the bottom wall to the top of the side wall and having at least one projection on one of its surfaces and at least one pair of mutually opposed shoulders on the other of its surfaces, the projection and shoulders being so arranged that when such identical containers are nested to form a stack the projection of one container co-operates with the shoulders of another container to hold the containers together in the stack, the width of the spacing between the pair of shoulders being less than the width of the projection and the shoulders being resiliently yieldable so that when the containers are brought together the shoulders of the other container are displaced circumferentially to allow the projection of the one container to pass between and engage behind them holding the containers together in the stack.

In the preferred form of container, there is a plurality of such projections and such pairs of shoulders. By placing the projections or the pairs of shoulders at regular intervals around the container and making the number of projections and the number of pairs of shoulders equal or one a whole number multiple of the other the containers can be made to interlock in many different relative angular positions about the container axis.

In one form of the invention a row of diamond-shaped projections is provided on the outside of the container providing the pairs of shoulders. Additional rows of diamond-shaped projections may be provided on the side wall of the container above the row which defines the shoulder in order to provide a grip by which the container may be held and in order to give the container an attractive appearance. The projections which engage the shoulders are formed on the inside of the container and may also be of diamond-shape, the sloping upper sides of the diamond-shaped projections facilitating entry of the projections into the openings formed between adjacent pairs of diamond-shaped projections on the outside of the container.

In another form of container according to the invention, the shoulders are formed by the ends of a series of arcuate projections, each of which subtends an angle greater than a 180° at the center of the arc. An opening is formed between the opposite ends of the arc which gives access to the recess formed inside the arc for the projections that cooperates with the shoulders. If the projections are provided on the outside of the container the openings between the ends of the arcuate projections will be at the lower side of the arc. The projections which engage the shoulders may be in the form of circular studs. The arcuate projections may be joined together to form a continuous projecting strip extending around the container to provide a grip by means of which the container may be held and to give the container an attractive appearance.

The provision of such diamond-shaped or arcuate projections all around the outside of the containers to provide pairs of shoulders give rise to difficulties in removing the containers from the mold because of the undercut formed by the shoulders. To provide for satisfactory removal of the containers from the mold cavity it is necessary to form the mold cavity in sections that can be separated.

It is therefore preferred that the pairs of shoulders or the projections, whichever are on the outside of the container should extend around only a part of the circumference of the container, the projections, or the parts bearing the pairs of shoulders, whichever is on the inside of the container, being uniformly distributed around the internal circumference of the container and tapering in height towards the bottom of the container. Preferably the shoulders are on the outside of the container and the projections are on the inside. In the preferred form of the invention the pairs of shoulders are grouped in two diametrically opposite sections which together extend around less than one half of the circumference of the container.

This design of container can be molded using a mould cavity which has only limited sections of the mold cavity wall which are movable relative to the rest of the mold cavity, these sections being the parts of the mold cavity wall which form the shoulders or projections on the outside of the container. The shoulders or projections can be formed with an undercut and removed from the mold after first retracting the movable sections. In the preferred form there are two sections carried on plungers which slide radially of the mold cavity in bores on diametrically opposite sides of the mold cavity. In this way the undercuts can be formed without using a mold cavity which is divided from top to bottom. Such a mold cavity would be much more expensive to make and use.

By tapering the height of the projections or shoulders on the inside of the container towards the bottom of the container, removal of the container from the male mold is facilitated.

Preferably the container is formed by a molding process so that the projections which define the shoulder are formed by areas in which the wall thickness of the container is increased. In this way the projections also serve to increase the heat insulation provided by the wall of the container in the region in which the container is gripped so that if the container contains a hot beverage the outside of the container is more comfortable to hold than if the container were of uniform thickness. The effect of increased insulation is also useful when the container contains a chilled beverage for preventing warmth from the hand heating the contents of the cup and for making the container more comfortable to hold. Preferably the container is formed by injection molding and the preferred material is polypropylene.

The container may include means for forming a sealed compartment between the bottoms of adjacent containers when the containers are stacked. These means may constitute a bottom portion to the side wall which is flared out towards the bottom of the container so that the exterior diameter of the side wall at the bottom of the container is equal to the internal diameter of the side wall at a distance above the bottom wall of the container such that when an identical container is placed inside the said container and the projections are engaged in the recesses the bottom of the container engages the inside of the side wall to form a seal and the space between the two bottom walls is sufficient to hold the dry ingredients for a beverage. Alternatively the inside of the container may be provided with an annular stacking shoulder spaced from the bottom wall which engages a stacking shoulder on the outside of the adjacent container when the containers are stacked to form a seal. The stacking shoulder on the inside of the container may be formed by increasing the thickness of the wall in the region of the shoulder. The stacking shoulder on the outside of the container may be provided by an axially extending annular flange at the bottom of the container which form a foot on which the container stands.

DESCRIPTION OF THE PREFERRED EMBODIMENTS

Embodiments of the invention will now be described by way of example with reference to the accompanying drawings, of which:

Figure 1:
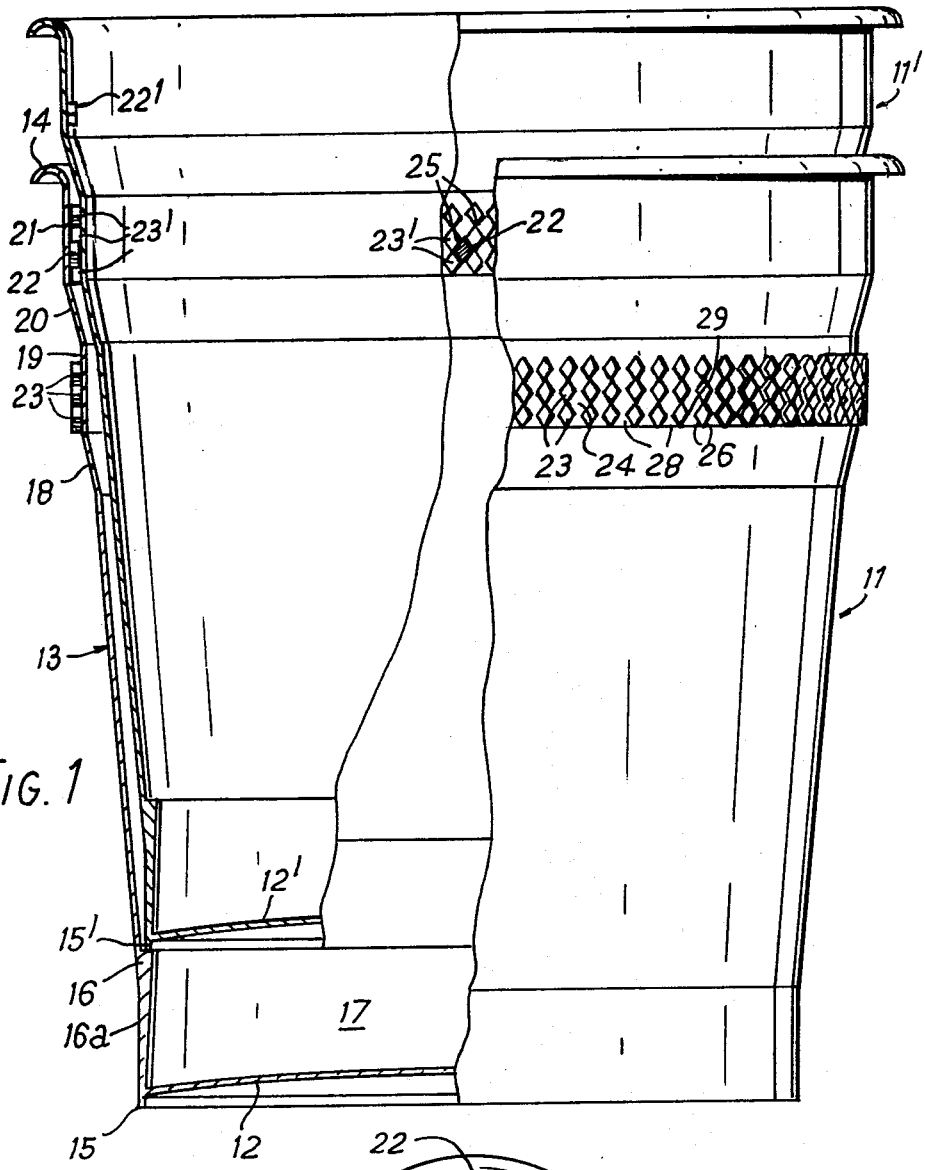
FIG. 1 shows a side elevation, partly in section, of two cups according to a first embodiment of the invention.
Figure 2:
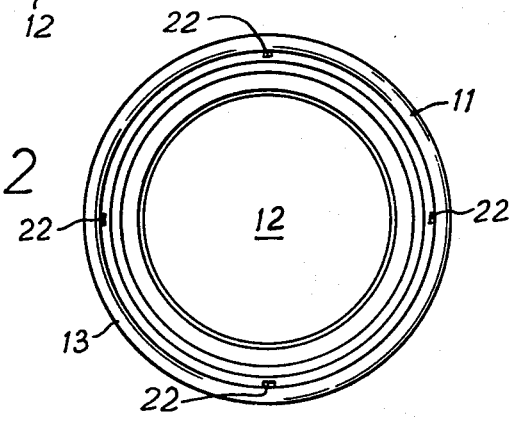
FIG. 2 shows a plan view on a smaller scale of one of the cups of FIG. 1.

Referring to FIGS. 1 and 2 these show a cup 11 formed of polypropylene by injection molding. The cup 11 comprises a bottom wall 12 which is bowed upwardly and a side wall 13. The side wall diverges from the bottom to the top where it terminates in a lip 14 which curves outwardly and downwardly. A downwardly projecting extension of the side wall below the bottom wall provides a foot 15 on which the cup stands. The lower portion **16*a* of the side wall increases in thickness from the bottom wall 12 up to an annular stacking shoulder 16. The inside surface of the side wall may be cylindrical or may converge upwardly in this region 16*a* and the outside surface may be cylindrical or flared towards the bottom. The inside diameter of the stacking shoulder is less than the diameter at the foot 15. When an identical cup 11' is nested inside the cup 11, the foot 15' of the cup 11' sits on the stacking shoulder 16 to seal the space 17 between the bottom wall 12 of the cup 11 and the bottom wall 12' of the cup 11'. Thus the foot 15'** also serves as a stacking shoulder.

Above the stacking shoulder 16 the thickness of the side wall 13 of the cup is reduced and the side wall continues upwardly and outwardly to a region 18 in which the slope of the wall increases. Immediately above the region 18 is a cylindrical region 19 and above the region 19 is a region 20 having the same outward slope as the region 18. A region 21 above the region 20 and below the lip 14 is also cylindrical. Because the side wall on its outside is cylindrical or slightly flared towards the bottom in the region **16*a*, the side wall 13' of the identical cup 11' is spaced from the side wall 13 of the cup 11 in the region above the shoulder 16. This spacing is maintained even in the cylindrical region 19 because of the region 18** of increased outward slope.

On the inside of the cup in the cylindrical region 21 are four diamond-shaped projections 22 uniformly spaced around the circumference of the cup. On the outside of the cup in the region 19 are three rows of diamond-shaped projections 23. The projections 23 are arranged in vertical columns with spaces between the projections of adjacent columns. All the projections 22 and 23 are of uniform cross-section throughout their height. The interstices between groups of four adjacent projections in the lowermost and middle rows form spaces or recesses 24 for receiving the internal projections 22 of an adjacent cup. This can be seen in FIG. 1 where two of the projections 22 of the cup 11 are shown in two of the recesses 24' between groups of four adjacent projections 23' on the outside of the cup 11'.

The spacing between adjacent pairs of diamond-shaped projections in the lowermost row provides openings 28 through which the projections 22 on the inside of the cup may be introduced into the spaces or recesses 24 when the cups are nested one inside another. The spacing between adjacent corners or shoulders of the projections that define the width of the opening is slightly less than the width of the projections 22 measured in the circumferential direction. The projections 23 are resilient and yield circumferentially to allow the projections 22 of the interlocking cup to pass between them as the projections are moved upwardly relative to the cup 11' to enter the recesses 24'. The sloping upper surfaces 25 of the projection 22 co-operate with the sloping lower surfaces 26 of the projections 23 in the lowermost row of projections to facilitate entry of the projection 22 into the recesses 24. The sloping upper surfaces 29 of the projections 23 of the lowermost row form shoulders which co-operate with the sloping lower surfaces of the projections 22 to hold the cups together.

The vertical spacing between the point on the lower surfaces of the projections 22 and the stacking shoulder 16 is slightly less than the vertical spacing between the corresponding point on the upper surfaces 29 of the projections 23 in the lowermost row and the foot 15 of the cup so that when the projection 22 is engaged in the recess 24' of the cup 11' the foot 15' is held firmly against the stacking shoulder 16 to form a seal. Because the cups 11 and 11' are formed of polypropylene which has a permeability to air and water vapor approximately 30 times less than polystyrene which is the material of which cups of this kind are usually formed, the space 17 between the bottom walls 12' and 12 is airtight, provided the seal formed by the foot and the shoulder is satisfactory, and the hygroscopic dry ingredients for a beverage placed in the chamber 17 will remain dry for a substantial period of time. The use of injection molding enables a much more accurate definition of the shape of the cup to be achieved than the thermoforming process usually used for making cups of this kind so that the formation of a good seal between the foot and the shoulder can more readily be achieved.

The known cups of polystyrene have to be enclosed in a special envelope highly impervious to moisture during distribution and prior to use in order to maintain the ingredients in the cups in satisfactory dry condition, because the cups themselves do not provide adequate protection against moisture. Once removed from the envelope the cups must be used within a few days. The improved sealing that can be achieved by the cups described above avoids these problems; the stacked cups themselves providing adequate protection against moisture. All that is required to protect the cups during distribution is a thin sleeve of polythene or similar relatively porous material for the sake of hygiene.

In addition to providing means for interlocking the cups, the projections 23 on the outside of the cup also serve to provide a grip for holding the cup. The middle and uppermost row of projections take little or no part in the interlocking of the cups. The projections provide areas of increased wall thickness and hence increased heat insulation making the cup more comfortable to hold when it contains a hot beverage. The projections also give the cup an attractive appearance.

Figure 3:
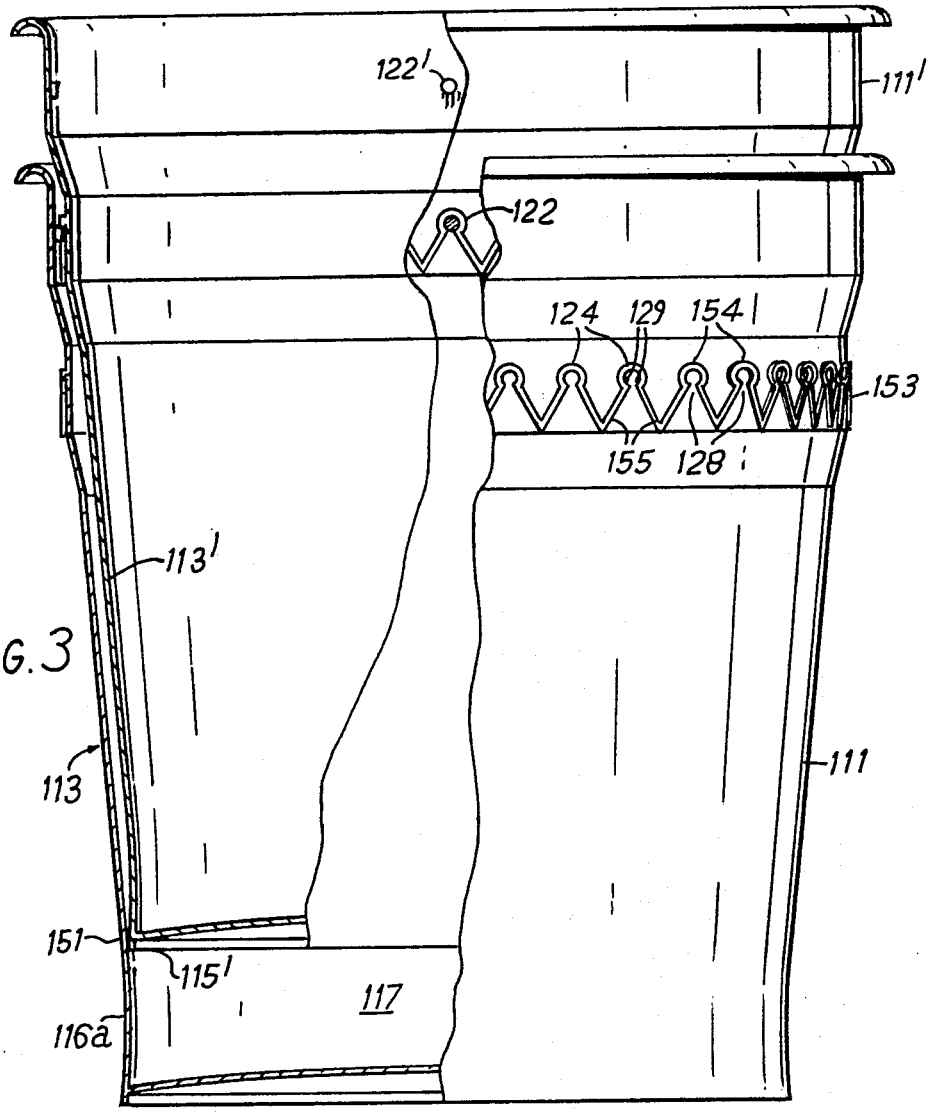
FIG. 3 shows a side elevation partly in section of two cups according to a second embodiment of the invention.
Figure 4:
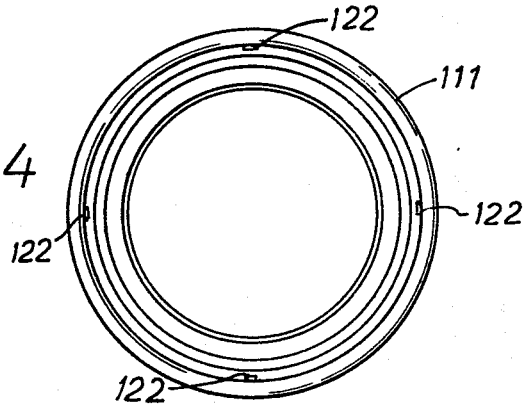
FIG. 4 shows a plan view on a smaller scale of one of the cups of FIG. 4.

FIGS. 3 and 4 show cups which are similar in many respects to the cups of FIGS. 1 and 2 and therefore the same reference numerals have been used for parts that are similar with the addition of the prefix 1.

The first main difference lies in the region **116*a* of the side wall 113 at the bottom of the cup, which is of uniform thickness and flares outwardly towards the bottom so that there is a region 151 spaced a substantial distance from the bottom of the cup which has the same internal diameter as the external diameter at the foot of the cup. When the cup 111' of FIG. 3 is nested inside the cup 111 of FIG. 3 the foot 115' of the cup 111' makes a wiping contact with the inside of the side wall of the cup 111 in the region 151. The resilience of the material from which the cups are made causes the foot 115' to be deflected inwardly and the side wall 113 to be deflected outwardly in the region 151 as the cup 111' is inserted in the cup 111 and thereby produces a sealing pressure between the foot 115' and the side wall 113 of the cup 111. The flaring of the side wall in the region 116*a* also ensures that there is a space between the side wall 113' of the cup 111' and the side wall 113 of the cup 111 above the region 151**.

The other major difference between the cup of FIGS. 3 and 4 and the cup of FIGS. 1 and 2 lies in the arrangement for interlocking the two cups. The cups 111 and 111' of FIG. 3 have in the region 121 on its inside four projecting studs 122 of circular cross-section spaced equally about the circumference of the cup. In the region 119 on the outside of the cup is a continuous projecting strip 153 made up of arcuate portions 154 which subtend an angle of more than 180° at the center of the arc, and V-shaped portions 155. The arcuate portions define spaces or recesses 124 with downwardly facing openings 128 formed between the opposite ends 129 of each arcuate portion. The V-shaped portions which link each pair of adjacent arcuate portions provide a lead-in to facilitate entry of the studs 122 into the openings 128 as two cups are telescoped one inside the other. The spacing between the opposite ends of each arcuate portion is slightly less than the diameter of the studs 122 and parts of the projection which defines the opening yield resiliently in a tangential direction to allow the stud to pass through the opening 128' into the recess 124' with a snapping action. Once the studs 122 have entered the recess 124' the ends of the arcuate portion act as shoulders 129 holding the studs in the recesses and maintaining the foot 115' in tight sealing engagement with the inside of the cup 111. The studs 122 are of uniform cross-section throughout their height.

In addition to providing means for locking the two cups together the projecting strip 153 also provides a region of increased insulation for holding the cup and a decoration to the cup. The vertical spacing between the studs 122 and the region 151 of the same internal diameter as the external diameter of the foot 115 is slightly less than the vertical spacing between the recesses 124 and the foot 115 so that the foot 115' is held in tight sealing engagement with the side wall of the cup when the cups 111 and 111' are interlocked.

In all other respects the cup of FIGS. 3 and 4 is identical to the cup of FIGS. 1 and 2.

It will be appreciated that the means for providing the sealing of the space 17 at the bottom of the cups shown in FIGS. 3 and 4 may be used in conjunction with the arrangement for interlocking the cups shown in FIGS. 1 and 2. Simiarly the arrangement for interlocking cups in FIGS. 3 and 4 may be used in conjunction with the means for sealing the space 17 shown in FIGS. 1 and 2.

In both the cups 11 and 111 the number of recesses 24 and 124 is a whole number multiple of the number of projections 22 and 122 so that the cups can be interlocked in many different positions of relative rotation about the axis of the cup.

Figure 5:
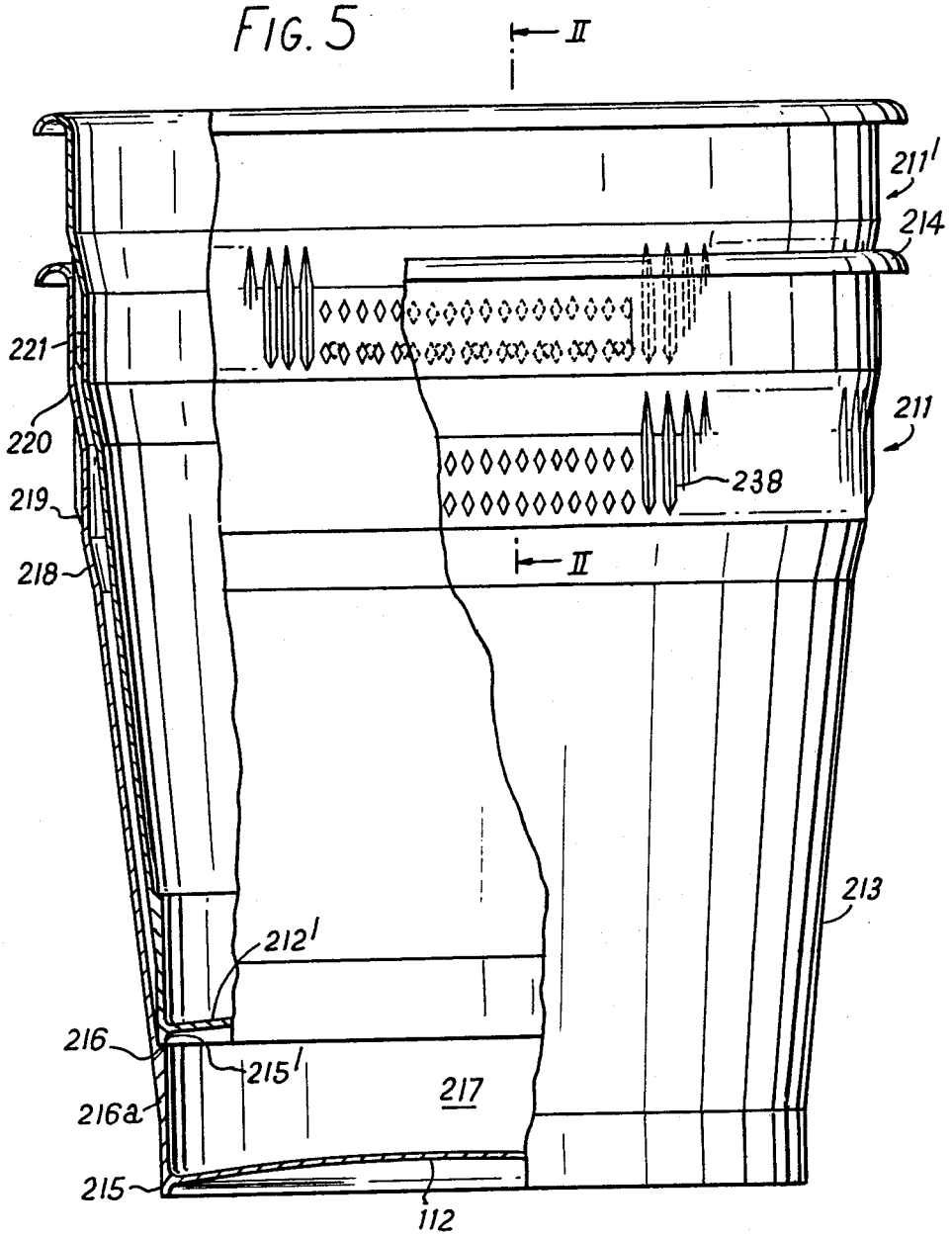
FIG. 5 shows a side elevation partly in section of two cups according to a third embodiment of the invention.
Figure 8:
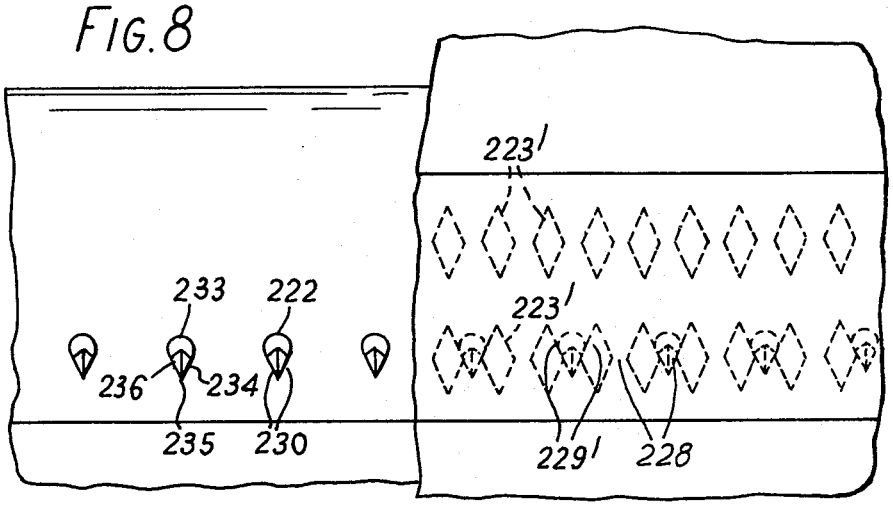
FIG. 8 shows an enlarged side view partly in section of the walls of the cups of FIG. 5 taken from inside the cups.

Referring to FIGS. 5 and 8 of the drawings these show a cup 211 which is similar to the cups 11 and 111 in many respects and therefore the same reference numerals have been used for parts that are similar but with the prefix 2. In the cup 211, the inside surface of the side wall is cylindrical in the region **216*a* and the outside surface is also cylindrical or diverged outwardly from the bottom upwards. The inside diameter of the stacking shoulder is less than the diameter at the foot 215. When an identical cup 211' is nested inside the cup 211, the foot 215' of the cup 211' sits on the shoulder 216 to seal the space 217 between the bottom wall 212 of the cup 211 and the bottom wall 212' of the cup 211'. Because the side wall on its outside is cylindrical in the region 216*a*, the side wall 213' of the identical cup 211' is spaced from the side wall 213 of the cup 211 in the region aboe the stacking shoulder 216. This spacing is maintained even in the cylindrical region 219 because of the region 218** of increased outward slope.

Figure 6:
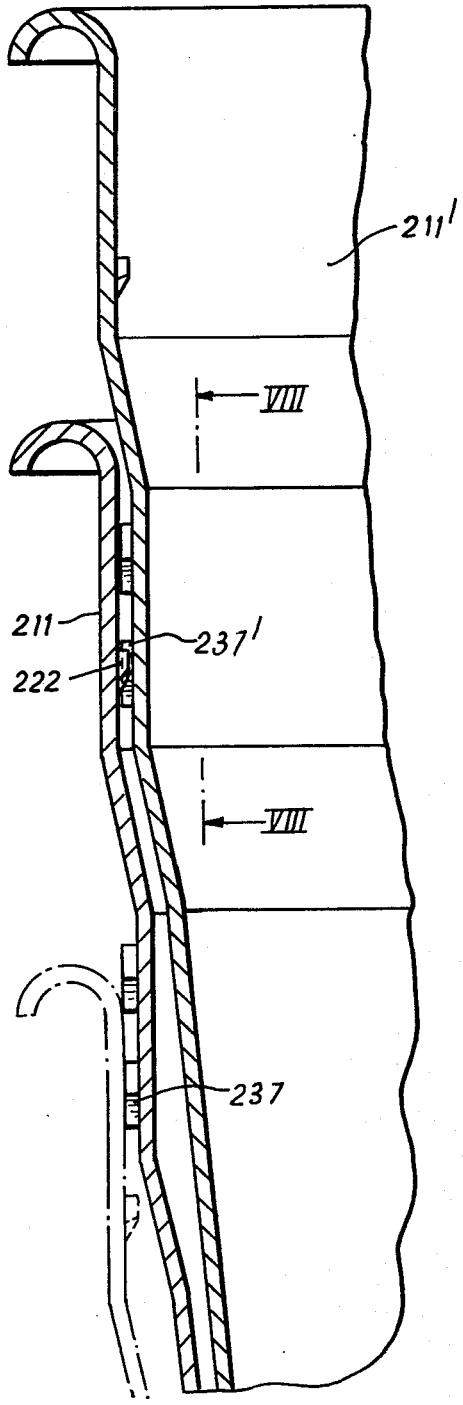
FIG. 6 shows an enlarged cross section along the line VI—VI of FIG. 5.
Figure 7:
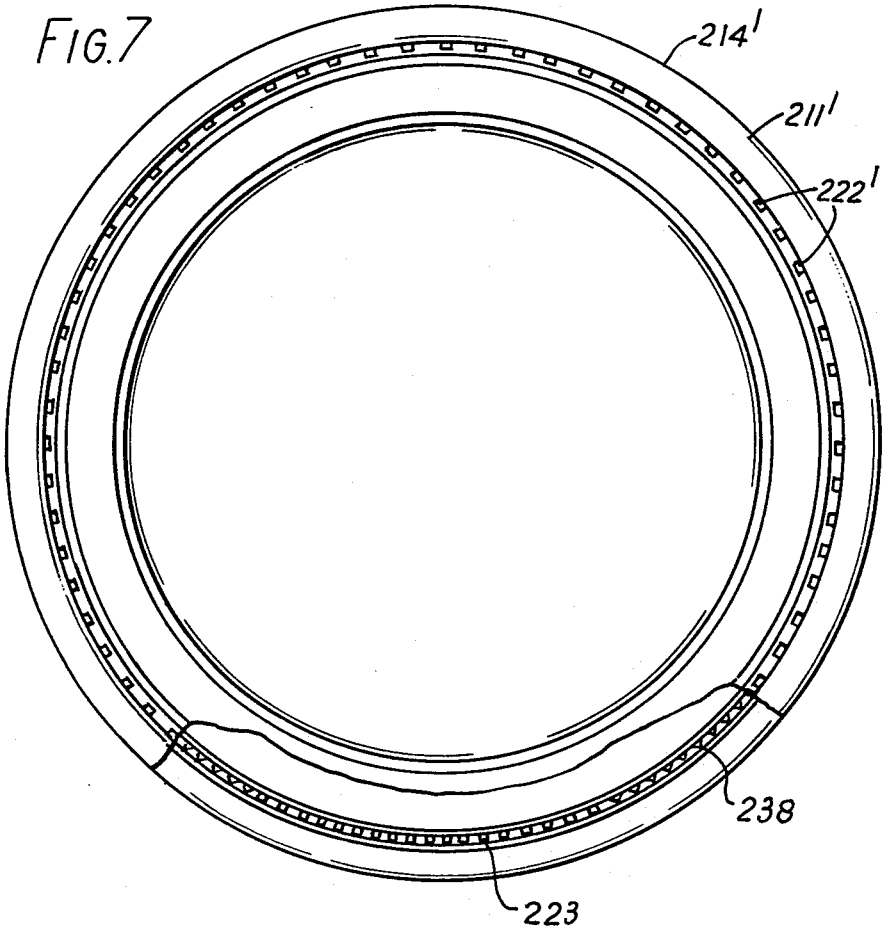
FIG. 7 shows a plan view, partly in section of the cups of FIG. 5.

On the inside of the cup in the cylindrical region 221 is a row of projections 222, uniformly spaced around the circumference of the cup. As can best be seen from FIGS. 6 and 8, each projection 222 has a flat disc-shaped upper part 233 integral with a lower part 234 which extends downwardly to a point 235 and has a central ridge 236 the height of which decreases towards the point 235. The projections slope from the ridge towards the sides. The tapering of the projections 222 towards the bottom of the cup facilitates removal of the cup from the male mold.

On the outside of the cup on diametrically opposite sides are two sets of projections 223. The projections 223 are diamond-shaped although other shapes may be used. The projections 223 are arranged in two rows and in the region 219, the rows of each set extend around about less than one sixth of the periphery of the cups. All the projections 223 have uniform cross sections throughout their height. Around the remainder of the periphery of the cups in the region 219 are vertical ribs 238 which have no undercuts.

The spacing between adjacent pairs of diamond-shaped projections in the lowermost row provides openings 228 through which the projections 222 on the inside of the cup may pass into the space or recess between the two rows of projections when the cups are nested one inside another. The spacing between adjacent corners of the projections that define the width of the opening is slightly less than the width of the projections 222 measured in the circumferential direction. The projections 223 are resilient and yield circumferentially to allow the projections 222 of the interlocking cup to pass between them as the projections are moved upwardly relative to the cup 211' to engage behind the diamond-shaped projections 223. The sloping upper surfaces 229 of the projections 223 in the lowermost row of projections form shoulders which cooperate with the sloping lower surfaces 230 of the projections 222 to hold the cups together.

The vertical spacing between a point on the lower surfaces of the projections 222 and the stacking shoulders 216 is slightly less than the vertical spacing between the corresponding point on the upper surfaces 229 of the projections 223 and the foot 215' of the cup so that when the projections 222 is engaged behind the shoulders formed by the projections 227' of the cup 211' the foot 215' is held firmly against the stacking shoulder 216 to form a seal.

In addition to providing means for interlocking the cups, the projections 223 together with the ribs 238 on the outside of the cup also serve to provide a grip for holding the cup. The upper row of projections takes no part in the interlocking of the cups. The projections provide areas of increased wall thickness and hence increased heat insulation making the cup more comfortable to hold when it contains a hot beverage. The projections also give the cup an attractive appearance.

The mold cavity which is used to form the cup 211 has movable wall sections in the region which form the projections 223, mounted on plungers which can be retracted to allow the cup to be removed from the mold.

Although the containers described above are made entirely of plastics material, it is envisaged that the invention may be applied to a container consisting of a structural framework of plastics materials which also provides the sealing surfaces and the means for holding the containers together in the stack, the spaces between the parts of the framework being filled with a different material such as paperboard to complete the container.

We claim:

1. A nestable container of resilient plastic material comprising:

a bottom wall;

a side wall, said side wall diverging generally from said bottom wall to the top of said wall;

at least one projection on one surface of said side wall;

at least one pair of circumferentially spaced mutually opposed shoulders with a spacing between them on the other surface of said side wall, said projection and said shoulders being so positioned that when such identical containers are nested to form a stack the projection of one container cooperates with the shoulders of another container to hold the containers together in the stack, the width of the spacing between said shoulders being less than the width of said projection, said shoulders being resiliently yieldable so that when the containers are brought together the shoulders of the other container are displaced circumferentially to allow said projection of said one container to pass between the shoulders of the other container and engage behind them holding the containers together in the stack.

2. A container according to claim 1 including a plurality of projections and a plurality of pairs of shoulders.

3. A nestable container of resilient plastics material comprising:

a bottom wall;

a side wall, said side wall diverging generally from said bottom wall to the top of said side wall;

a plurality of projections on one surface of said side wall;

a plurality of pairs of mutually opposed shoulders with a spacing between the shoulders in each pair on the other surface of said side wall, said projections and said pairs of shoulders being so positioned that when such identical containers are nested to form a stack the projections of one container cooperate with the pairs of shoulders of another container to hold the containers together in the stack, the width of the spacings between each shoulder in each of the pairs of shoulders being less than the width of said projections; said shoulders being resiliently yieldable so that when the containers are brought together the pairs of shoulders of the other container are displaced circumferentially to allow said projections of said one container to pass between the pairs of shoulders of the other container and engage behind them, holding the containers together in the stack;

said projections and said pairs of shoulders being disposed at regular intervals around the container with the number of projections and the number of pairs of shoulders being equal or a whole number multiple of the other.

4. A container according to claim 3 including a row of spaced projections on the outside of the container, the parts of the projections at the sides of each space between projections constituting the pairs of opposed shoulders.

5. A container according to claim 4 including an additional row or rows of projections provided on the outside of the cup above the row that provides the shoulder.

6. A container according to claim 4 in which the projections on the inside of the cup that co-operate with the shoulders have a disc-shaped upper part and a lower part integral with the upper part, the lower part having sides which taper towards the bottom of the cup to a point and having a central ridge the height of which decreases towards the point, each projection sloping from its ridge towards its sides.

7. A container according to claim 3 including a series of arcuate projecting portions each of which subtends an angle greater than 180° at the center of arc, the said shoulders being formed by the opposite ends of each projecting portion.

8. A container according to claim 7 in which the arcuate projecting portions are on the outside of the cup and the openings between the ends of the arcuate projecting portions are at the lower side of the arc.

9. A container according to claim 8 in which the arcuate projecting portions are joined to form a continuous projecting strip extending around the container.

10. A container according to claim 1 in which the parts which define the pair of shoulders and the projection are formed by areas of increased wall thickness.

11. A container according to claim 10 in which the container is formed by injection molding.

12. A container according to claim 11 in which the container is fabricated of polypropylene.

13. A container according to claim 12 further comprising means for forming a sealed compartment between the bottom of adjacent containers when such identical containers are stacked.

14. A container according to claim 13 in which the means comprise a bottom portion of the side wall which is flared out towards the bottom of the container so that the exterior diameter of the side wall at the bottom of the container is equal to the internal diameter of the side wall at a distance above the bottom wall of the container.

15. A container according to claim 13 in which the inside of the container has an annular stacking shoulder spaced from the bottom wall which engages a stacking shoulder on the outside of the adjacent container when identical containers are stacked to form a seal.

16. A container according to claim 3 in which the container has an inside surface and an outside surface and in which the pairs of shoulders or the projections, whichever are on the outside of the container, are provided around only a part of the circumference of the container, the projections or the parts becoming the pairs of shoulders, whichever are on the inside of the container, being uniformly distributed around the internal circumference of the container and tapering in height towards the bottom of the container.

17. A container according to claim 16 in which the pairs of shoulders are provided on the outside of the container and are grouped in two diametrically opposite sections which together extend around less than one half the circumference of the container.

18. A container according to claim 16 including axially extending ribs in the outside of the container, said ribs being provided on the part of the circumference on the outside of the container that is free of said pairs of shoulders or projections.

19. A container according to claim 3 in which the parts which define the pair of shoulders and the projections are formed by areas of increased wall thickness.

20. A container according to claim 19 which is formed by injection molding.

21. A container according to claim 18 in which the container is fabricated of polypropylene.

22. A container according to claim 3 further comprising means for forming a sealed compartment between the bottom of adjacent containers when such identical containers are stacked.

23. A container according to claim 22 in which the means comprise a bottom portion of the side wall which is flared out towards the bottom of the container so that the exterior diameter of the side wall at the bottom of the container is equal to the internal diameter of the side wall at a distance above the bottom wall of the container.

24. A container according to claim 22 in which the inside of the container has an annular stacking shoulder spaced from the bottom wall which engages a stacking shoulder on the outside of the adjacent container when identical containers are stacked to form a seal.

25. A nestable container of resilient plastics material comprising:

a bottom wall;

a side wall, said side wall diverging generally from said bottom wall to the top of said side wall;

said side wall having an inside surface and an outside surface thereon, a plurality of projections on one surface of said side wall;

a plurality of pairs of mutually opposed shoulders with a spacing between them on the other surface of said sidewall, the pairs of shoulders or the projections, whichever are on the outside of the container, are provided around only a part of the circumference of the container, the projections or the parts becoming the pairs of shoulders, whichever are on the inside of the container, being uniformly distributed around the internal cicumference of the container and tapering in height towards the bottom of the container;

said projections and said shoulders being so positioned that when such identical containers are nested to form a stack the projections of one container cooperate with the shoulders of another container to hold the containers together in the stack, the width of the spacing between said shoulders being less than the width of said projections, said shoulders being resiliently yieldable so that when the containers are brought together the shoulders of the other container are displaced circumferentially to allow said projections of said one container to pass between the shoulders of the other container and engage behind them to hold the containers together in the stack.

26. A container according to claim 25 in which the pairs of shoulders are provided on the outside of the container and are grouped in two diametrically opposite sections which together extend around less than one half the circumference of the container.

27. A container according to claim 25 including axially extending ribs on the outside of the container, said ribs being provided on the part of the circumference on the outside of the container that is free of said pairs of shoulders or projections.

* * * * *